US008893317B2

(12) United States Patent
Smith

(10) Patent No.: US 8,893,317 B2
(45) Date of Patent: Nov. 25, 2014

(54) TOILET TRAINING DEVICE

(76) Inventor: Zoe Smith, Muizenburg (ZA)

( * ) Notice: Subject to any disclaimer, the term of this patent is extended or adjusted under 35 U.S.C. 154(b) by 279 days.

(21) Appl. No.: 13/057,328

(22) PCT Filed: Aug. 5, 2009

(86) PCT No.: PCT/IB2009/053400

§ 371 (c)(1),
(2), (4) Date: Feb. 3, 2011

(87) PCT Pub. No.: WO2010/016012

PCT Pub. Date: Feb. 11, 2010

(65) Prior Publication Data

US 2011/0131718 A1 Jun. 9, 2011

(30) Foreign Application Priority Data

Aug. 5, 2008 (ZA) ..... 2008/06772

(51) Int. Cl.

| | |
|---|---|
| ***A47K 11/04*** | (2006.01) |
| ***A47K 13/00*** | (2006.01) |
| ***A47K 11/06*** | (2006.01) |
| ***A47K 13/06*** | (2006.01) |

(52) U.S. Cl.
CPC ..... *A47K 11/06* (2013.01); *A47K 13/06* (2013.01)
USPC ..... 4/483; 4/239

(58) Field of Classification Search
CPC ..... A47K 13/06; A47K 13/005; A47K 11/04
USPC ..... 4/476–483, 254
See application file for complete search history.

(56) References Cited

U.S. PATENT DOCUMENTS

| | | | | |
|---|---|---|---|---|
| 2,249,322 | A * | 7/1941 | McQuaid | 4/239 |
| 2,662,229 | A * | 12/1953 | Wenkstern | 4/476 |
| 3,343,179 | A * | 9/1967 | Sellars, Jr. et al. | 4/476 |

(Continued)

FOREIGN PATENT DOCUMENTS

| | | |
|---|---|---|
| JP | 4-59792 | 5/1992 |
| JP | 2004033714 | 2/2004 |
| WO | WO 2007/104101 A1 | 9/2007 |

OTHER PUBLICATIONS

International Search Report from International Application No. PCT/IB2009/053400, dated Dec. 3, 2009 (date of completion of search) and Dec. 10, 2009 (date of mailing of report).

*Primary Examiner* — Huyen Le
*Assistant Examiner* — Janie Christiansen
(74) *Attorney, Agent, or Firm* — Clark & Elbing LLP

(57) ABSTRACT

A toilet training device includes a seat defining a cavity shaped to accommodate a child, with an aperture the seat, and a base on which the seat can be mounted. The base defines a pair of receptacles of unequal size. The seat has a peripheral rim for mounting the seat on the base or on the rim of a toilet, and a central seat member which extends below the rim. The aperture is formed near the base of the seat member and has a teardrop shape which accommodates both male and female children. The seat includes a backrest at a first end thereof, the backrest being shaped to support a child using the device. The backrest defines a predetermined angle relative to the vertical to hold the child's body in a correct position for use of the device. The seat can be used in conjunction with the base in first and second "potty" configurations, and can be located on the rim of a toilet bowl in a third configuration of the device.

17 Claims, 3 Drawing Sheets

(56) References Cited

U.S. PATENT DOCUMENTS

| | | | | | |
|---|---|---|---|---|---|
| 3,520,005 | A | | 7/1970 | Downes | |
| 4,069,522 | A | * | 1/1978 | Messmer et al. | 4/483 |
| 4,300,249 | A | * | 11/1981 | Taylor | 4/661 |
| 5,199,112 | A | * | 4/1993 | Locarno | 4/239 |
| 5,778,460 | A | | 7/1998 | Doell et al. | |
| 6,029,289 | A | * | 2/2000 | Jakobson et al. | 4/483 |
| 6,626,487 | B1 | * | 9/2003 | Buitendach | 297/153 |
| D570,970 | S | * | 6/2008 | Buitendach | D23/296 |
| 7,665,157 | B2 | * | 2/2010 | Deutsch | 4/483 |
| 2005/0132484 | A1 | | 6/2005 | Chao | |
| 2005/0188455 | A1 | | 9/2005 | Sharp | |
| 2010/0138984 | A1 | * | 6/2010 | Buitendach | 4/239 |

* cited by examiner

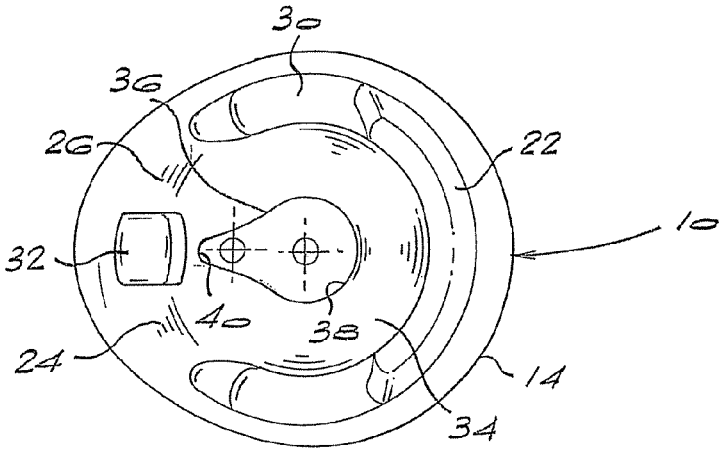
Fig. 4
Fig. 5
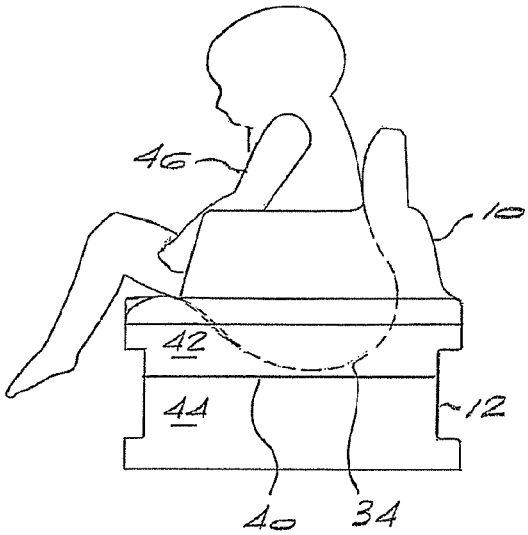
Fig. 6
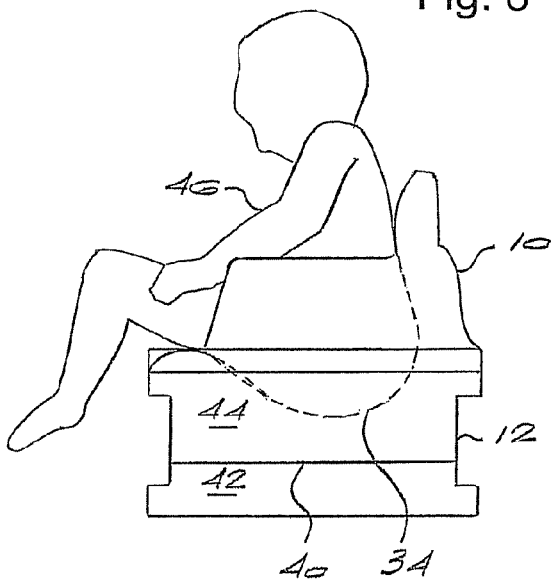
Fig. 7
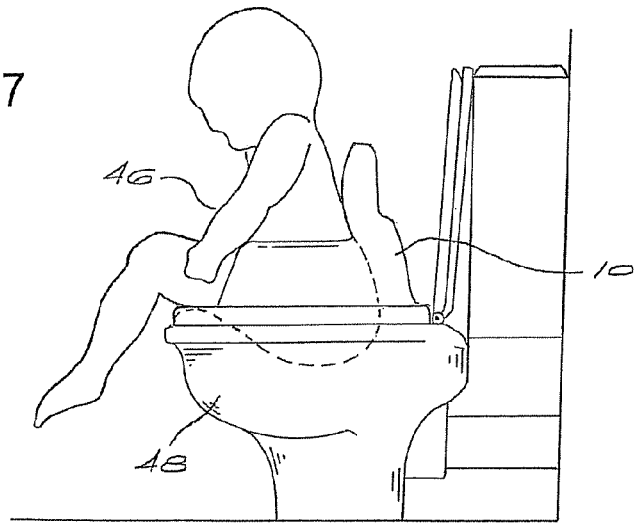

TOILET TRAINING DEVICE

CROSS-REFERENCE TO RELATED APPLICATIONS

This application is the U.S. national stage filing under 35 U.S.C. §371 of international application PCT/IB2009/053400, filed Aug. 5, 2009, which claims benefit of South Africa Patent Application 2008/06772, filed Aug. 5, 2008.

BACKGROUND OF THE INVENTION

This invention relates to a toilet training device.

Toilet training of small children is generally undertaken when they are between 18 and 24 months old, and it is not uncommon for a child still to be wearing diapers up to the age of three. The adverse environmental impact as a result of "nappy mountains" is well known. Using fewer nappies not only helps to save the environment but also reduces the cost of nappies to the parent or caregiver.

Conventionally, various toilet training aids are used. The most basic of these is a chamber pot or "potty" which the child is taught to use as a step towards the use of a conventional flushing toilet. The child relieves him/herself in the pot and the parent or other caregiver has to empty the contents of the pot into the toilet bowl. The transition from the potty to the adult toilet is a big step.

Other devices for assisting in toilet training are known. For example, a step-up stool is known which enables a child to reach a toilet seat. Although this aid helps the child to climb up to the toilet seat, the aid is mainly suited for use by older toddlers and creates a risk of falling.

Generally, existing toilet training devices are not suitable for very young children (especially children under the age of 18 months) and require substantial intervention and supervision by an adult for effective use.

It is an object of the present invention to provide an alternative toilet training device.

SUMMARY OF THE INVENTION

According to the invention there is provided a toilet training device, the device including:

- a seat defining a cavity shaped to accommodate a child, the seat having an aperture therein; and
- a base on which the seat can be mounted, the base defining at least one receptacle.

The seat preferably has a peripheral rim for mounting the seat on the base or on a toilet, and a central seat member which extends below the rim.

The seat may include a backrest at a first end thereof, the backrest being shaped to support a child using the device and defining a predetermined angle relative to the vertical to hold the child's body in a correct position for use of the device.

Preferably, the backrest is inclined forward over the cavity at an angle $\alpha$ of between 5 and 15 degrees from the vertical, preferably about 10 degrees from the vertical, so that a child using the device is forced to lean forwards slightly.

The seat may include an upstanding side wall defining opposed side support members extending forward from the backrest about the cavity, to assist in supporting a child upright in the seat.

Preferably, the upstanding side wall defines at least one opening at a second end of the device opposed to the first end, to allow the child's legs to extend forward and beyond the side wall when the child is seated in the device.

Preferably, the upstanding side wall defines a pair of openings, one to receive each leg of the child, with an upstanding wall portion between the openings.

Preferably, said at least one opening defines a leg support surface for supporting the underside of the child's legs which is inclined at a predetermined angle relative to the horizontal.

Preferably, the leg support surface is inclined backwardly towards the cavity at an angle $\beta$ of between 5 and 15 degrees from the horizontal, preferably about 10 degrees from the horizontal.

The included angle between the backrest and the leg support surface is typically an acute angle $\theta$ of between 60 and 80 degrees, preferably about 70 degrees.

The aperture in the seat is preferably teardrop shaped in plan, with an enlarged first end portion located centrally in the seat at or near the lowermost portion of the cavity defined therein, and a tapered second end portion extending forwardly away from the backrest. The aperture is anatomically shaped to fit the infant/toddler's bottom.

The base may comprise an upstanding side wall and a transversely extending partition member defining at least a first receptacle.

Preferably, the partition member is located between upper and lower edges of the upstanding side wall and defines first and second receptacles of unequal depth.

The seat and the base are preferably formed with complemental engaging formations to enable the seat to be located securely on the base.

The complemental engaging formations on the seat and the base preferably correspond to the shape of the rim of a conventional toilet bowl, so that the seat can be located either on the base or on the rim of a toilet bowl in use.

BRIEF DESCRIPTION OF THE DRAWINGS

FIG. 4 is a plan view of the device;

FIGS. 5 to 7 are schematic side views showing the device in use, in three different configurations thereof.

DESCRIPTION OF AN EMBODIMENT

Figure 1:
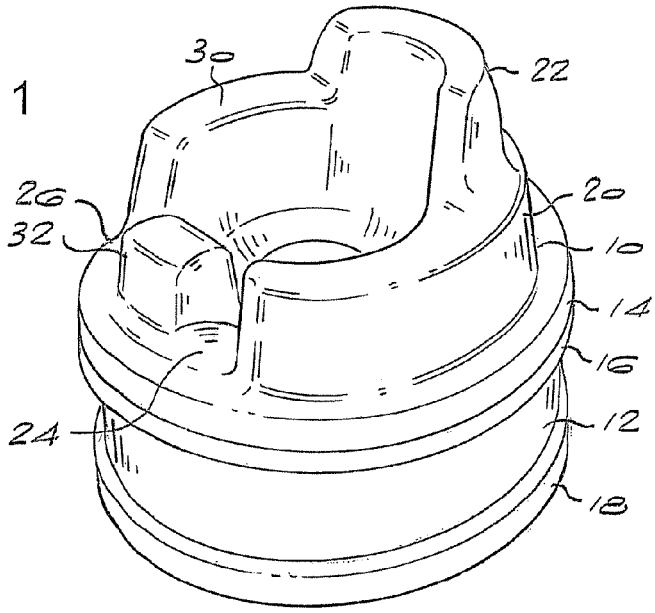
FIG. 1 is a pictorial view of a toilet training device according to the invention.

FIG. 1 shows an embodiment of a toilet training device according to the present invention. The device comprises a seat 10 and a base 12.

The seat is preferably moulded as a single piece from a firm but soft plastics material, such as polyurethane foam or another material having suitable characteristics. The material used should be sufficiently firm and dense to maintain its shape in use but preferably be soft to the touch and deformable to an extent, to allow it to have a water resistant outer layer with an easily cleanable surface, and be as light as possible. Ideally the material would be recyclable or biodegradable.

The seat 10 has a peripheral rim 14 which defines a stepped mounting formation which is generally oval or egg-shaped in plan, corresponding to the general shape of the rim of a standard toilet bowl. The mounting formation is shaped to fit over complemental mounting formations on the base 12, in the form of flanges 16 and 18. The latter are shaped to correspond to the profile of the rim of a conventional toilet bowl, so that the seat can also be mounted firmly but removably on top of either the base or a toilet bowl. The above-mentioned degree of deformability allows the seat to be fitted to toilet bowls of slightly varying shape.

Figure 3:
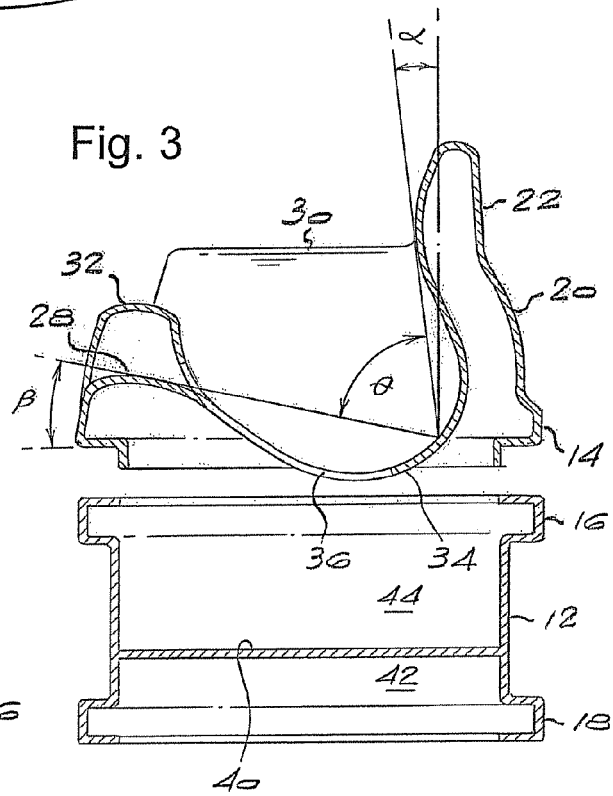
FIG. 3 is a sectional view on the line 3-3 in FIG. 2.
Figure 8:
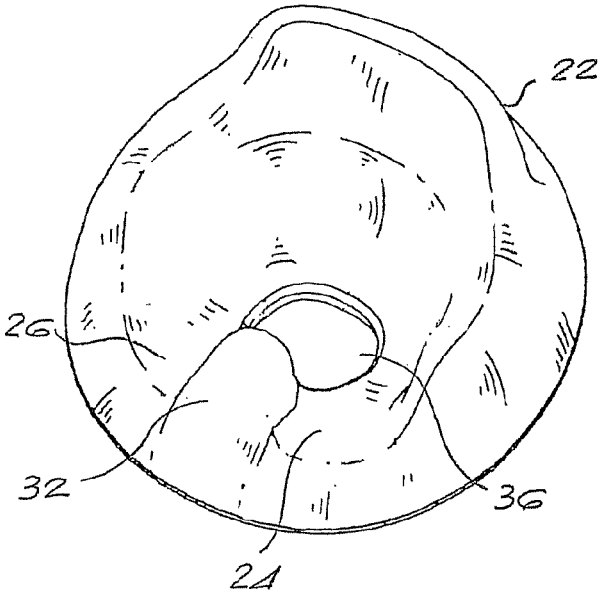
FIGS. 8, 9, 10 and 11 are pictorial, plan, elevation and sectional views, respectively, of an alternative embodiment of the device.
Figure 9:
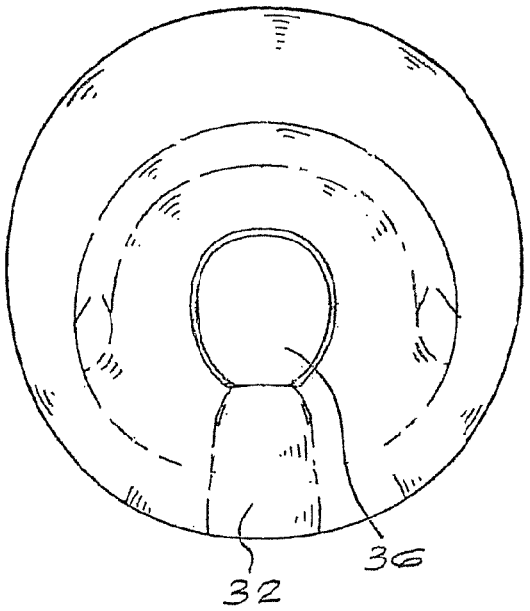
Figure 10:
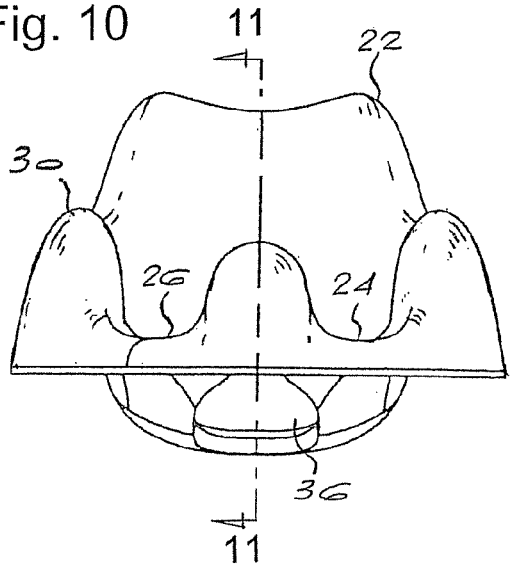
Figure 11:
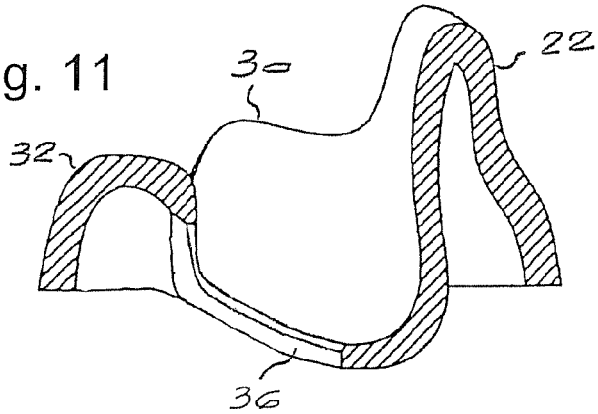

An upstanding side wall 20 extends upwardly from the peripheral rim 14. At a first, rear end of the seat, the side wall extends upwardly to define a backrest 22. As best seen in the sectional view of FIG. 3, the inner surface of the backrest has a tapered profile which is inclined forwardly from the vertical at an angle $\alpha$ which is typically from 5 to 15 degrees, preferably about 10 degrees.

The upstanding side wall 20 extends forwardly from the back rest towards a second, front end of the seat, where two openings 24 and 26 are formed in the side wall to allow the legs of a child seated in the device to protrude. Where the side wall 20 extends forwardly from either side of the backrest 22, its upper edge 30 is lower than the top of the backrest 22 and the height thereof is chosen to assist in keeping an infant in the seat. Between the openings 24 and 26 is a small section 32 of the upstanding side wall which lends itself to be used as a grip or "pommel" (similarly to the pommel of a saddle). In the prototype device, the upper edge 30 of the side wall 20 was approximately 13 cm above the lower edge of the rim 14, while the upper end of the grip or "pommel" 32 was approximately 10 cm above the lower edge of the rim.

The openings 24 and 26 define generally flat, slightly convexly curved leg support surfaces 28 (see FIG. 3) which are inclined relative to the horizontal at an angle $\beta$ of between 5 and 15 degrees, preferably about 10 degrees. Thus, the included angle $\theta$ between the support surfaces 28 and the inner surface of the backrest 22 is an acute angle between 60 and 80 degrees, most preferably about 70 degrees.

The central portion of the seat 10 comprises a seat member 34 which is shaped to receive the buttocks of a child, with the child's back in contact with the inner surface of the backrest 22 and the child's legs extending through the openings 24 and 26. An opening or aperture 36 in the seat member is sized and located to allow a child to urinate and defecate freely there through into a toilet bowl or a receptacle defined by the base 12, as described below. As can be seen most clearly from FIG. 3, the lowermost portion of the seat member 34 extends approximately 8 cm below the peripheral rim 14 of the seat.

In the prototype device, the internal distance from front to back of the seat, between the inner surface of the backrest 22 and the inner surface of the "pommel" 32 was approximately 16 cm, while the internal distance between the upstanding side walls from side to side was approximately 20 cm. The overall height of the seat itself was approximately 22 cm, and about 35 cm when used together with the base, measured from the top of the backrest.

The shape of the opening 36 is shown more clearly in the plan view of FIG. 4. The aperture is generally teardrop shaped, with an enlarged first end portion 38 which is located approximately centrally in the seat member, and a tapered second end portion 40 which extends forwardly, away from the backrest 22 towards the upstanding wall portion 32, as shown. It can be seen that the tapered end portion 40 extends up the curved surface of the seat member 34 and that its extreme end is higher than the enlarged first end portion 38. In the prototype device, the overall length and width of the aperture were approximately 16 cm and 8 cm, respectively, and the distance between the tapered end portion 40 of the aperture and the top of the "pommel" 32 was approximately 4 cm.

The size and shape of the aperture, which is fitted and curved anatomically, are designed to accommodate children of varying ages from about 4 months to 3 years of age, and to allow unimpeded discharge of urine and faeces from both male and female children while being no larger than necessary. The design of the fitted and curved aperture addresses the issue of horizontal urination by males, with the upwardly extending tapered end portion 40 accommodating a male child's penis without obstruction.

Figure 2:
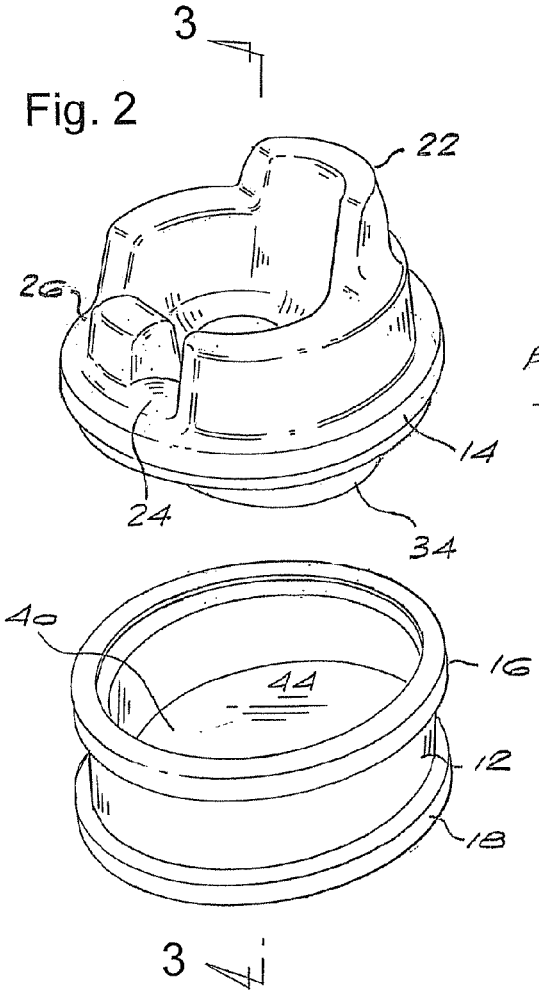
FIG. 2 is an exploded view of a seat and a base of the toilet training device.

Referring again to FIGS. 1, 2 and 3, the base 12 of the device has an internal partition 40 which extends transversely between the inner surfaces of the side wall 12 to define a first receptacle 42 and a second receptacle 44 on either side of the partition. The partition is closer to the flange 18 than to the flange 16, so that the receptacles 42 and 44 are of different sizes. In the prototype, the overall height of the base 12 was about 13 cm, with the partition being spaced 9 cm from one end and 4 cm from the other end of the base. Thus, when the seat 10 is mounted on the base 12, the lowermost part of the seat member 34 is either just above the partition 40, or spaced apart from the partition 40, depending on the orientation of the base. This allows the device to be used in the different ways illustrated in FIGS. 5, 6 and 7.

In FIG. 5, the device is shown in a first configuration referred to as a "Beginner's system" (or "Stage 1"). In this configuration, the seat 10 is mounted on the base 12 with the shallower receptacle 42 uppermost. In this configuration, the lowermost part of the seat member 34 is a few millimeters above the partition 40.

In FIG. 6, the device is shown in a second configuration referred to an "Intermediate system" (or "Stage 2"). In this configuration the orientation of the base 12 is reversed so that the larger receptacle 44 is uppermost. In this configuration, the underside of the seat member 34 is spaced a few centimeters above the partition 40.

When a very small child uses the device for the first time, the configuration of FIG. 5 results in the base of the receptacle (that is, the uppermost surface of the partition 40) being clearly visible through the aperture 36, so that the child is not made uncomfortable by the sight of a deep or dark cavity below the seat. This helps to acclimatize the child initially to the use of the device.

Once the child is a little older and larger, the base 12 can be reversed to create a deeper receptacle below the seat in the second configuration of the apparatus. In FIG. 7, the device is shown in a third configuration referred to as the "Advanced system" (or "Stage 3"), with the seat 12 now being placed directly on the rim of a toilet bowl 48. In all cases, the lowermost part of the seat member 34 extends below the rim 14 of the seat in use, ensuring that the effective centre of gravity of the device is low and enhancing the stability of the device in use. The fact that the seat member extends below the mounting rim of the seat has the effect that the child sits relatively low in the seat, and is not raised above the floor excessively, making the experience of using the device easy and non-threatening.

This, together with the shape of the backrest, the upstanding side wall and the openings to receive the child's legs, makes it very unlikely that even an active child will be able to fall out of the device in use.

The device is sized to be usable with children between 4 months and 3 years of age, and offers sufficient support to allow even a 4 month old to use the device securely. By the time a child has graduated to using the device on top of a toilet as shown in FIG. 7, he/she will be almost completely toilet trained.

The described device makes it possible to start toilet training as soon as the infant is comfortably able to sit up supported by the device and is able to hold his/her head up. This can be as early as 4 months of age and does not cause any distress to the infant, but works on the simple basics of body position, gravity and psychology.

An alternative embodiment of the device is shown in FIGS. 8 to 11. This embodiment is generally similar to the first embodiment, but has more rounded contours and slightly different geometry. For example, the opening or aperture 36 in the base of the seat extends forward somewhat further than in the first embodiment. Also, this version does not have a flanged edge for seating on the rim of a toilet bowl, but will instead be formed with internal ribs (not shown) to ensure correct seating in use.

The invention claimed is:

1. A toilet training device, the device including:

a seat having a curved surface defining a cavity shaped to accommodate a child, the seat having an aperture therein; and a backrest at a first end of the seat, the backrest being shaped to support a body of a child using the device, wherein the backrest is inclined forward towards the cavity at an angle α of between 5 and 15 degrees from the vertical over substantially the entire length of the backrest and is configured to contact the lower back of the child to force the child to lean forward slightly and to hold the child's body in a correct position for use of the device;

wherein the seat includes an upstanding side wall defining opposed side support members extending forward from the backrest about the cavity, to assist in supporting a child upright in the seat, the upstanding side wall defining at least one opening at a second end of the device opposed to the first end, to allow the child's legs to extend forward and beyond the side wall when the child is seated in the device, said at least one opening defining a leg support surface for supporting the underside of the child's legs which is inclined backwardly towards the cavity at a predetermined angle relative to the horizontal, such that the child is held in a squat position in which his/her legs are raised and his/her upper body is forced slightly forward when seated in the cavity of the seat; and wherein the aperture in the seat is teardrop shaped in plan, with an enlarged first end portion located centrally in the seat at or near a lowermost portion of the cavity defined therein, and a tapered second end portion extending forwardly away from the backrest, the tapered second end portion extending up said curved surface of the seat defining the cavity so that its extreme end is higher than the enlarged first end portion in use.

2. A toilet training device according to claim 1 wherein the seat has a peripheral rim for mounting the seat on a base or on a toilet, and a central seat member which extends below the rim.

3. A toilet training device according to claim 1 wherein the backrest is inclined forward over the cavity at an angle α of about 10 degrees from the vertical.

4. A toilet training device according to claim 1, wherein the upstanding side wall defines a pair of openings, one to receive each leg of the child, with an upstanding wall portion between the openings.

5. A toilet training device according to claim 1, wherein the leg support surface is inclined backwardly towards the cavity at an angle β of between 5 and 15 degrees from the horizontal.

6. A toilet training device according to claim 5 wherein the leg support surface is inclined backwardly towards the cavity at an angle β of about 10 degrees from the horizontal.

7. A toilet training device according to claim 1, wherein the included angle between the backrest and the leg support surface is an acute angle θ of between 60 and 80 degrees.

8. A toilet training device according to claim 7 wherein the included angle between the backrest and the leg support surface is an acute angle θ of about 70 degrees.

9. A toilet training device according to claim 1 including a base on which the seat can be mounted, the base defining at least one receptacle.

10. A toilet training device according to claim 9 wherein the base comprises an upstanding side wall and a transversely extending partition member defining at least a first receptacle.

11. A toilet training device according to claim 10 wherein the partition member is located between upper and lower edges of the upstanding side wall and defines first and second receptacles of unequal depth.

12. A toilet training device according to claim 10 wherein the seat and the base are formed with complemental engaging formations to enable the seat to be located securely on the base.

13. A toilet training device according to claim 12 wherein the complemental engaging formations on the seat and the base correspond to the shape of the rim of a conventional toilet bowl, so that the seat can be located either on the base or on the rim of a toilet bowl in use.

14. A toilet training device according to claim 1 wherein the device is a single molded piece.

15. A toilet training device according to claim 1 wherein the device comprises a firm material that maintains its shape in use.

16. A toilet training device according to claim 15 wherein the device comprises a plastics material.

17. A toilet training device according to claim 1 wherein the device is sized to accommodate a child aged about 4 months to about 3 years.

* * * * *